US005287663A

United States Patent [19]

Pierce et al.

[11] Patent Number: 5,287,663

[45] Date of Patent: Feb. 22, 1994

[54] POLISHING PAD AND METHOD FOR POLISHING SEMICONDUCTOR WAFERS

[75] Inventors: John M. Pierce, Palo Alto; Peter H. Renteln, Cupertino, both of Calif.

[73] Assignee: National Semiconductor Corporation, Santa Clara, Calif.

[21] Appl. No.: 874,823

[22] Filed: Apr. 28, 1992

Related U.S. Application Data

[63] Continuation of Ser. No. 824,709, Jan. 21, 1992, abandoned.

[51] Int. Cl.[5] ..... B24D 11/00

[52] U.S. Cl. ..... 51/401; 51/395

[58] Field of Search ..... 51/401, 402, 407, 394, 51/395, 397

[56] References Cited

U.S. PATENT DOCUMENTS

| | | | |
|---|---|---|---|
| 3,863,395 | 2/1975 | Brown | 51/121 |
| 4,450,652 | 5/1984 | Walsh | 51/356 |
| 5,020,283 | 6/1991 | Tuttle | 51/209 DL |

FOREIGN PATENT DOCUMENTS

| | | |
|---|---|---|
| 0139410 | 5/1985 | European Pat. Off. . |
| 0167679 | 1/1986 | European Pat. Off. . |
| 652171 | 10/1937 | Fed. Rep. of Germany . |
| 3232814 | 3/1983 | Fed. Rep. of Germany . |

*Primary Examiner*—M. Rachuba

*Attorney, Agent, or Firm*—Limbach & Limbach

[57] ABSTRACT

A polishing pad and a method for polishing semiconductor wafers. The polishing pad includes a polishing layer and a rigid layer. The rigid layer adjacent the polishing layer imparts a controlled rigidity to the polishing layer. The resilient layer adjacent the rigid layer provides substantially uniform pressure to the rigid layer. During operation, the rigid layer and the resilient layer apply an elastic flexure pressure to the polishing layer to induce a controlled flex in the polishing layer to conform to the global topography of the wafer surface while maintaining a controlled rigidity over the local topography of the wafer surface.

7 Claims, 4 Drawing Sheets

POLISHING PAD AND METHOD FOR POLISHING SEMICONDUCTOR WAFERS

This is a continuation of application Ser. No. 07/824,709, filed Jan. 21, 1992, now abandoned.

BACKGROUND OF THE INVENTION

1. Field of the Invention

The present invention relates to a three layered polishing pad and a method for polishing and planarizing irregular surfaces, such as semiconductor wafers.

2. Background of the Invention

Semiconductor wafers are cut from ingots of single crystal silicon which are formed by withdrawing a seed from a silicon melt rotating in a crucible. The ingot is then sliced into individual wafers using a diamond cutting blade. Following the cutting operation, at least one surface of the wafer is polished to a relatively flat, scratch-free surface. Due to manufacturing irregularities, however, the thickness of the wafers equally vary. For example, the thickness of six inch wafers may range from 0.650 to 0.700 mm. Furthermore, the thickness of each wafer may vary by as much as 3.0 um across the wafer.

In the manufacture of integrated circuit semiconductor devices, the polished surface area of the wafer is first subdivided into a plurality of locations at which integrated circuits (IC) are formed. A series of wafer masking and processing steps are used to fabricate each IC. Thereafter, the individual ICs are cut or scribed from the wafer and individually packaged and tested to complete the device manufacture process.

The masking and processing steps during fabrication may result in the formation of topographical irregularities on the wafer surface. For example, topographical surface irregularities are created after metallization, which includes the sequence of blanketing the wafer surface with a conductive metal layer and then etching away unwanted portions of the blanket metal layer to form a metallization interconnect pattern on each IC.

The height differential (h) between the metal interconnect and the wafer surface where the metal has been removed results in a wafer surface irregularity commonly referred to as a step. On a very large-scale integrated (VLSI) IC, the step features can average 1 um or more in height and have a lateral surface dimension ranging from approximately 1 um to more than 1 mm. A typical VLSI chip on which a first metallization layer has been defined may contain several million steps, and the whole wafer may contain several hundred ICs.

Referring to FIG. 1, a perspective view of a processed semiconductor wafer 10 is shown. The wafer 10 includes a plurality of ICs 12. Each IC 12 includes a center region 14 which usually includes a high degree of device integration, and an outer periphery region 16 which typically has a relatively lower degree of device integration. Each IC is separated from the other ICs by scribe lines 18.

Referring to FIG. 2, a cross section of the wafer of FIG. 1 taken along line 2'—2' is shown. The cross sectional view of the wafer 10 illustrates several characteristics which are typically found on a wafer after Metallization. First, the thickness of the wafer is not uniform. The center region 30 of the wafer 10 has a thickness of $T_1$ which is thicker than the peripheral regions 32 of the wafer having a thickness $T_2$. It should be noted that wafer 10 is merely illustrative, and that the regions at which the thickness of the wafer may vary may occur at different portions of the wafer.

Second, a higher percentage of the center regions 14 of each IC 12 are elevated due to the high degree of device integration in these regions. In contrast, a substantially lower percentage of the peripheral regions 16 of each IC are lower with respect to the center regions 14 due to the lower degree of device integration. Hereinafter, the center regions 14 and peripheral regions 16 are referred to as high density regions 14 and low density regions 16 respectively.

Third, the high degree of device integration in the high density regions 14 creates a large number of steps 34 on the surface of the wafer. The gaps between each step 34 in the high density regions 14 generally have a lateral dimension of one micron or less. In contrast, the low degree of device integration in the low density regions 16 creates a relatively smaller number of steps 34 in these regions. The gaps between steps in the low density regions 16 may range from 1 micron to one millimeter, and the gaps between two high density regions 14 may range from 0.5 to 3.0 millimeters in lateral dimension. (Note, the thickness disparity ($T_1$ vs. $T_2$), the height and lateral dimensions of the steps 34, and the gaps between the steps relative to the dimensions of the wafer are greatly exaggerated for clarity.)

Fourth, a dielectric layer 19, such as silicon dioxide, is deposited over the wafer surface by a chemical deposition or another known technique. The dielectric layer 19 assumes the same topography as the underlying wafer surface.

Referring to FIG. 3, an exploded view of a high density region 14 between lines 3'—3' of the cross section of the wafer 10 of FIG. 2 is shown. This exploded cross section view illustrates that wafer topography irregularities are also created by trench isolation, which is common technique used in VLSI circuits to prevent latch up and to increase device density. The exploded cross section view of FIG. 3 includes an n-channel device 40 and a p-channel device 42 built in an n-well 43 in wafer 10. A dielectric trench 44 separates devices 40 and 42 in the substrate 10. A first metallization layer 45 electrically couples devices 40 and 42. Dielectric layer 19 covers the top surface of the devices 40 and 42 and the topography of the wafer above the trench 44 is raised above the remainder of the wafer surface.

The lack of planarization due to metallization and trench isolation on the wafer surface can cause significant problems during wafer fabrication. For example, the steps 34 on the high density and low density regions 14 and 16 respectively may cause focusing problems during optical lithography. Since the dielectric layer 19 which is deposited over the wafer surface after metallization and trench isolation assumes the irregularities of the wafer surface, the lack of surface planarization may make it difficult or impossible to lay down subsequent layers of metal interconnect, thus limiting the number of metallization layers that can be practically used in device manufacture.

Polishing the dielectric layer 19 on the surface of a wafer after metallization and/or other selected stages in the fabrication process is one known method for planarizing wafer surface topography. Since the dielectric layer 19 covers the surface of the wafer, it provides a layer of uniform composition for planarization.

Referring to FIG. 4, a cross section of a standard wafer polishing apparatus is shown. The polishing apparatus 20 includes a platen 21 for supporting a polishing pad 23, a wafer chuck 24 having side walls 25a and 25b and a resilient pad 2 6. The back of the unprocessed surface 27 of a wafer 10 rests against resilient pad 26 and is positioned by side walls 25a and 25b in wafer chuck 24. The processed surface 28 of the wafer is thus in contact with and exposed to the polishing pad 23 during operation.

The platen 21 rotates about a first axis 29a. The wafer chuck 24 and wafer 10 rotate about a second axis 29b which is substantially in parallel with axis 29a. A member 61 moves the rotating wafer chuck 24 horizontally across the surface of the polishing pad 23. As wafer 10 is rotated, its processed surface 28 moves across the polishing surface of the polishing pad 23.

During operation, a slurry of colloidal silica or another suitable abrasive is introduced between the dielectric layer on the wafer 10 and the polishing pad 23. The reaction between the slurry and the dielectric layer under the polishing motion results in the chemical-mechanical removal of the dielectric on the wafer surface. Ideally, the dielectric material would be typically removed faster over the high density regions 14 than in the low density regions 16 on the wafer surface. Thus, the topography of the wafer surface would be polished and planarized. In actuality, less than ideal results are obtained using polishing pads known in the art today.

Referring to FIG. 5, a two-layered polishing pad according to the prior art is shown. The pad 36 includes a resilient layer 37 and a polishing layer 38 covering the resilient layer. When placed in contact with a processed surface of the wafer, the polishing layer maintains contact with the high density regions 14. The polishing layer 38 bridges the gaps in the high density regions 14 since lateral distance of the gaps in the high density regions 14 are in the order of 1 micron.

The resilient layer 37 however forces the polishing layer 38 into the low density regions 16 so that the polishing layer 38 conforms to the local topography of the low density regions 16.

The two-layered polishing pad 36 has a number of deficiencies. The materials for the polishing layer 38 known in the art, such as urethane, are not rigid enough, causing the polishing layer 38 to conform generally to the low density regions 16 and to any gaps which are greater than approximately 1 mm in lateral dimension. As a result, the rate at which the polishing pad 36 removes dielectric material from the high density and low density regions 14 and 16, respectively, or any gaps with a lateral dimension of 1 mm or greater, is substantially equal. Accordingly, the pad of FIG. 5 has a leveling length, which is defined as the lateral distance over which the pad will maintain its rigidity over a local portion of the wafer, of approximately 1 mm, which is too short and does not result in the planarization of the wafer surface.

The lack of rigidity of the polishing pad 36 also results in the uneven rate of dielectric material removal over regions of different device integration density. Since the polishing force in both high density and low density regions are substantially equal, the polishing pressure applied to the low density regions is greater than the polishing pressure in the high density regions because there is less surface area of the polishing pad in contact with the wafer topography in the low density regions. As a result, the dielectric material is removed faster in the low density regions 16. The uneven removal rate may lead to excess removal of the dielectric layer 19 on the wafer surface, which may destroy the underlying devices.

Furthermore, the polishing layer performs the dual role of polishing the wafer surface and providing a rigidity to the polishing surface of the pad. Therefore, the mechanical properties of the two layer pad are vulnerable to change due to wear and use of the pad. The two layered polishing pad thus exhibits changes over time in its ability to planarize. This is undesirable because the mass production of wafers requires consistency.

Published European patent application, No. 0223920, discloses a method of polishing semiconductor wafers using a chemical-mechanical polishing technique with an improved polishing slurry. The polishing pad material is made of a polyester material is firm enough so that it does not deform under the polishing load.

Semiconductor manufacturers also use other methods for wafer planarization, such as spin on glass (SOG). In the SOG procedure, a sacrificial layer of glass is spun onto the dielectric layer 19. Ideally, the glass flows and fills in the low density regions 16 and gaps prior to curing. Thereafter, the glass layer and dielectric layer 19 are etched back at the same rate, leaving behind a planar wafer surface.

The SOG technique also has major deficiencies. First, the glass is only capable of filling gaps up to approximately 40 microns. Gaps of 40 microns or greater are only partially filled by the glass. Second, the etch rates of the glass and the dielectric are not identical. Accordingly, the larger gaps such as the low density regions 16 remain unfilled and therefore are not level with the high density regions 14, and the surface remains non-planar after etch back.

The failure of prior art planarization techniques significantly reduces chip yields and greatly increases IC manufacturing costs. The failure to planarize the wafer surface limits the number of subsequent metallization layers that can be used to build the ICs on the wafer. Lastly, a non-planar wafer surface limits the critical dimension, which is defined as the smallest feature of on the wafer surface, such as the geometrical gate length, which can be fabricated on the wafer surface. Smaller feature sizes require a lithography tool with a shallower depth of field and this requires better planarization of the wafer surface.

SUMMARY OF THE INVENTION

The present invention provides a polishing pad suitable for polishing semiconductor wafers and a method of using a polishing pad to polish semiconductor wafers. The polishing pad of the present invention includes a polishing layer, a rigid layer, and a resilient layer. The rigid layer, adjacent the polishing layer, imparts a controlled rigidity to the polishing layer. The resilient layer, adjacent the rigid layer, provides substantially uniform pressure to the rigid layer. During operation, the rigid layer and the resilient layer apply an elastic flexure pressure to the polishing layer to induce a controlled flex in the polishing layer to conform to the global topography of the wafer surface, while maintaining a controlled rigidity over the local topography of the wafer surface.

The polishing pad of the present invention provides several advantages. First, the controlled flex of the pad compensates for variations of thickness in the wafer. Second, the controlled rigidity of the rigid layer enables the pad to bridge gaps having both short and long range lateral dimensions on the wafer surface. Third, the resilient layer redistributes some of the polishing pressure away from the low density regions to prevent over polishing in these regions. Fourth, because the rigid layer and the polishing layer are distinct, the rigidity and other mechanical characteristics of the rigid layer do not change with used of the pad. Thus, consistency in wafer planarization is obtained.

The polishing pad of the present invention provides planarization across the entire topography of the wafer surface. The problems associated with prior art planarization techniques, including: focusing problems during optical lithography; the limitation on the number of metallization layers that can be placed onto the wafer surface are eliminated; and the changes in the pads rigidity due to use are eliminated.

DESCRIPTION OF THE INVENTION

Figure 6:
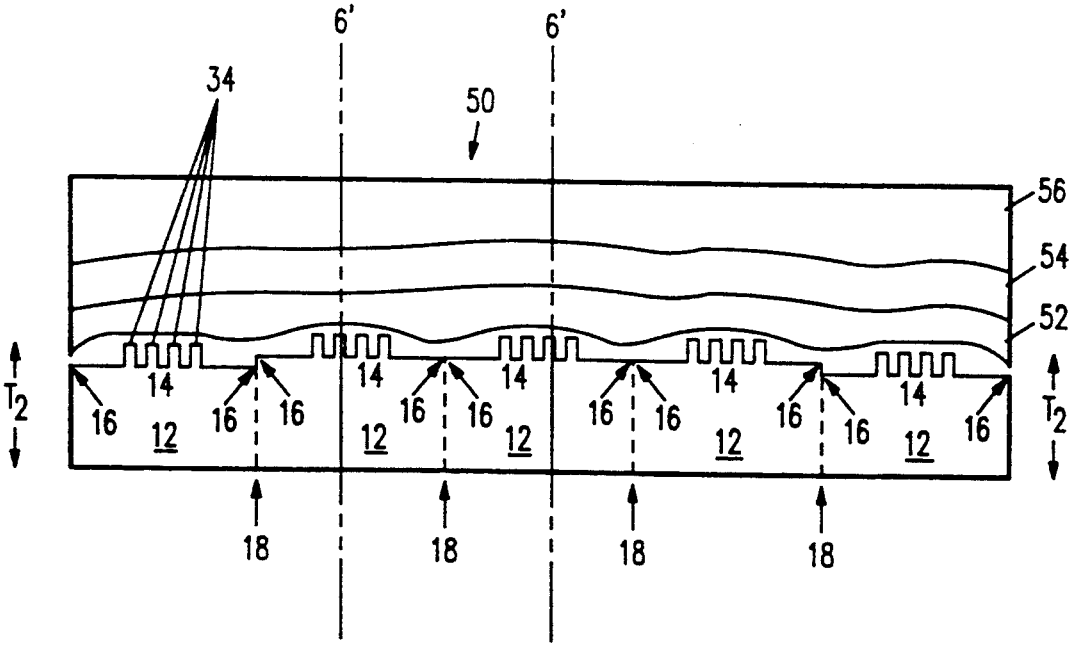
FIG. 6 is a cross section of a three-layered polishing pad with a thin polishing layer, a rigid layer and a resilient layer according to the present invention.

Referring now to FIG. 6, a polishing pad 50 having a polishing layer 52, a rigid layer 54, and a resilient layer 56 according to the present invention is shown. The polishing pad So is designed to operate in the polishing apparatus 20 of FIG. 4. The three layers are bonded together and to the platen 21 of polishing apparatus 20 with adhesives which are well known in the art. The elements which perform the same or similar function as described with reference to FIGS. 1-5 are indicated by the same reference numerals in FIG. 6.

Polishing layer 52 is composed of a material having good polishing characteristics, such as urethane or composites of urethane and other materials. The polishing layer 52 is also thin and relatively incompressible. In a preferred embodiment of the present invention, polishing layer 52 should be no more than 0.003 inches thick and have a compression modulus in the range of 600 to 2000 pounds per square inch. A polishing layer 52 of different thickness may be used, provided the polishing layer material used has a compression modulus which compensates for the difference in the thickness of the layer.

Rigid layer 54 provides a backing of controlled rigidity to the polishing layer 52. The rigid layer 54 should be made of a material which is resistant to chemical attack by the slurry and obtainable in sheets large enough to cover the platen 21 of the polishing apparatus 20. Since the rigid layer 54 is not directly exposed to the wafer surface, its mechanical properties do not change with use of the polishing pad 50. Thus the polishing layer 52 is able to consistently planarize wafers in a manufacturing environment.

In one embodiment of the present invention, the rigid layer 54 is made of stainless steel and has a modulus of elasticity in the range of (15E6) to (30E6) psi, and a thickness in the range of 0.010 to 0.018 inches. In other embodiments, other materials such as polyester, mylar and fiberglass may be used for the rigid layer 54. Since these materials have a lower modulus of elasticity than steel, they would have to be thicker than a steel rigid layer.

The resilient layer 56 is made of a compressible material capable of imparting a relatively even resilient pressure to the rigid layer 54. In a preferred embodiment of the present invention, the resilient layer 56 is made of a urethane-impregnated felt with a compression modulus in the 300–600 psi range and thickness in the 0.030–0.100 inch range. The resilient layer provides mechanical insulation between the rigid platen 21 of polishing machine 20 and the rigid layer 54 of pad 50. In other embodiments, a different thickness pad may be used provided the material used has a compensating resiliency.

The three-layered polishing pad 50 is designed to operate in an elastic flexure mode. The rigid layer 54 applies an elastic flexure pressure to the polishing surface to induce a controlled flex in the polishing surface so that it conforms to the global topography of the surface of the wafer while maintaining a controlled rigidity over the local topography of the wafer surface.

In the elastic flexure mode, the rigid layer 54 receives the relatively uniform resilient pressure on its surface adjacent to the resilient layer 56. The rigid layer 54 transforms this uniform pressure to the polishing layer 52, causing it to flex a controlled amount so that the polishing layer 52 conforms to the global topography of the wafer. As shown in FIG. 6, the curvature of the polishing layer 52 and rigid layer 54 illustrates how the pad 50 flexes to conform to the thickness variations ($T_1$ versus $T_2$) of the wafer. As noted in the background of the invention, thickness of a processed wafer may vary up to 3.0 um across the wafer.

The polishing layer 52 is sufficiently thin to completely conform to the flexure of the rigid layer 54. The polishing layer 52 does not affect or change the rigidity of rigid layer 54. The polishing layer 52 therefore bridges the gaps defined by the low density regions 16 over localized portions of the wafer, while maintaining polishing contact with high density regions 14. The rigid layer 54 redistributes some of the polishing pressure away from the low density regions 16 to the high density regions 14. Thus, the polishing pressure and force applied to the low density regions is controlled, preventing excessive removal of the dielectric from these regions. The mechanical properties of the rigid layer 52 can be selected so that the leveling length of the pad is capable of bridging gaps ranging from 0.1 mm to 2.0 cm on the wafer surface. In a preferred embodiment, the rigidity of the rigid layer 52 is selected so that the leveling length of the pad 50 is set to equal the largest lateral gap on the wafer surface, which in most situations is the gap between two high density regions 14, which usually equals 0.7 cm.

Alternatively, in the high density regions which typically have gaps in the order of 1 um, the polishing pad 50 does not flex. A rigid polishing surface is thus provided over the local portion(s) of the wafer where the high density regions 14 are located.

Figure 1:
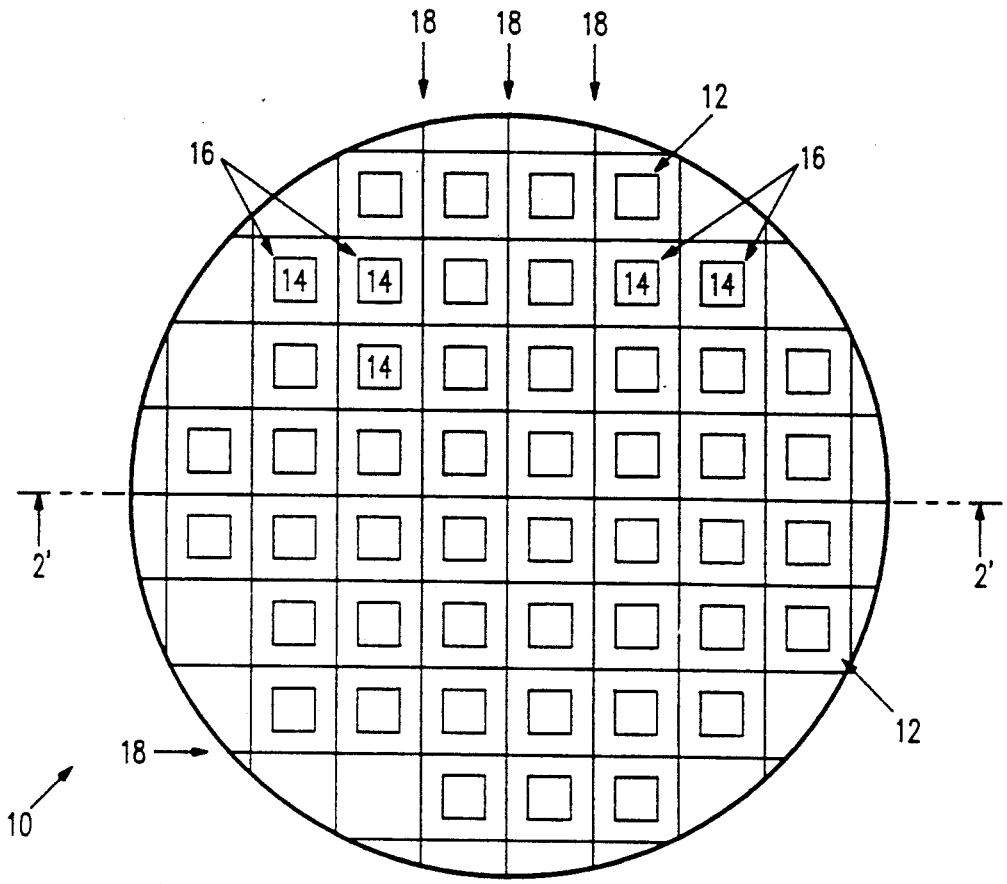
PRIOR ART FIG. 1
FIG. 1 is a top view of a processed semiconductor wafer according to the prior art.
Figure 2:
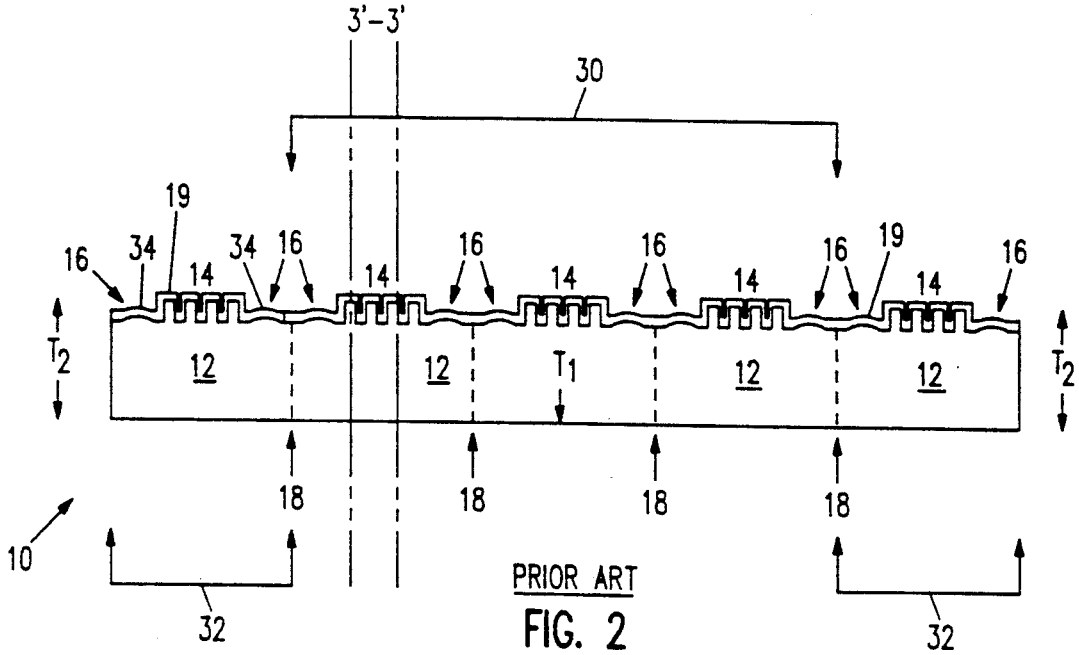
PRIOR ART FIG. 2
FIG. 2 is a cross sectional view taken along the lines 2'—2' of the wafer of FIG. 1 according to the present invention.
Figure 3:
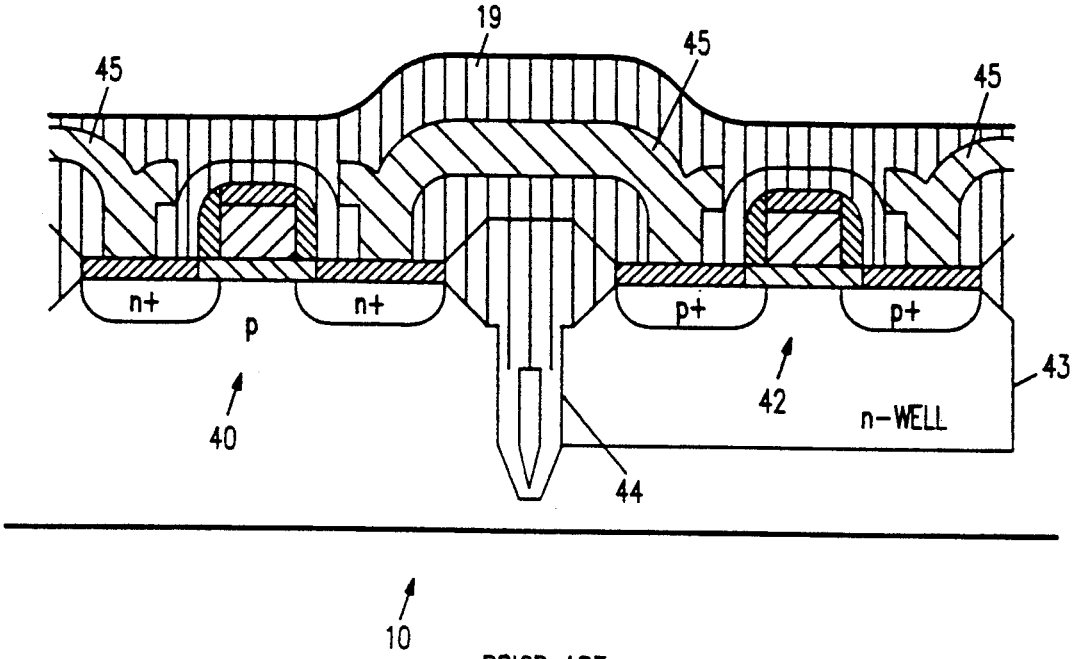
PRIOR ART FIG. 3
FIG. 3 is an exploded cross section view of a high density region on the wafer of FIG. 2 taken along lines 3'—3'.
Figure 7:
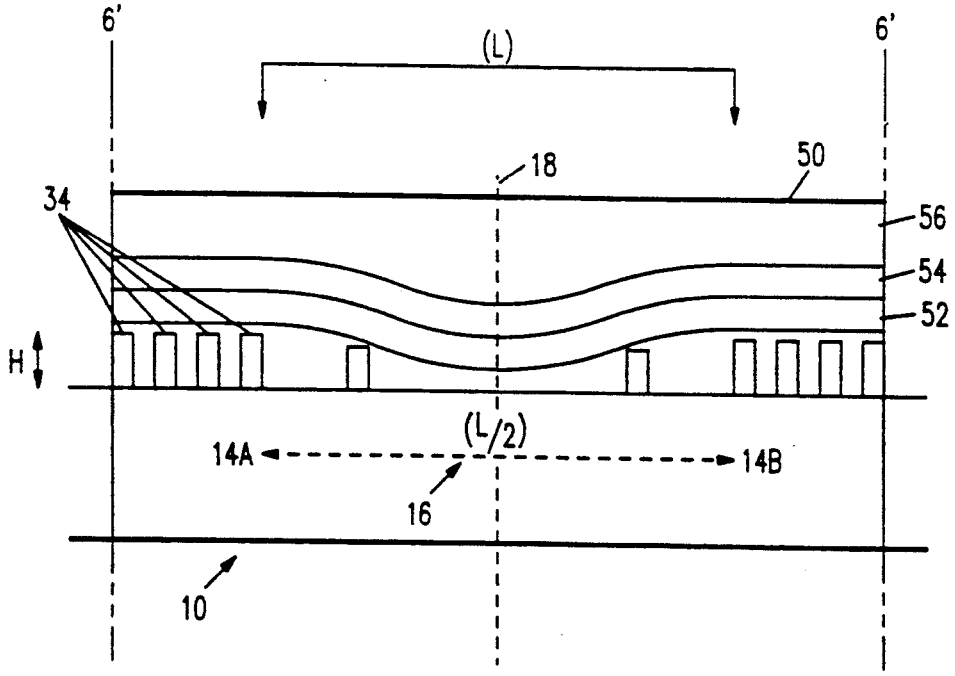
FIG. 7 is an exploded view of a low density region of the wafer shown in FIG. 6 taken along lines 6'—6'.
Figure 4:
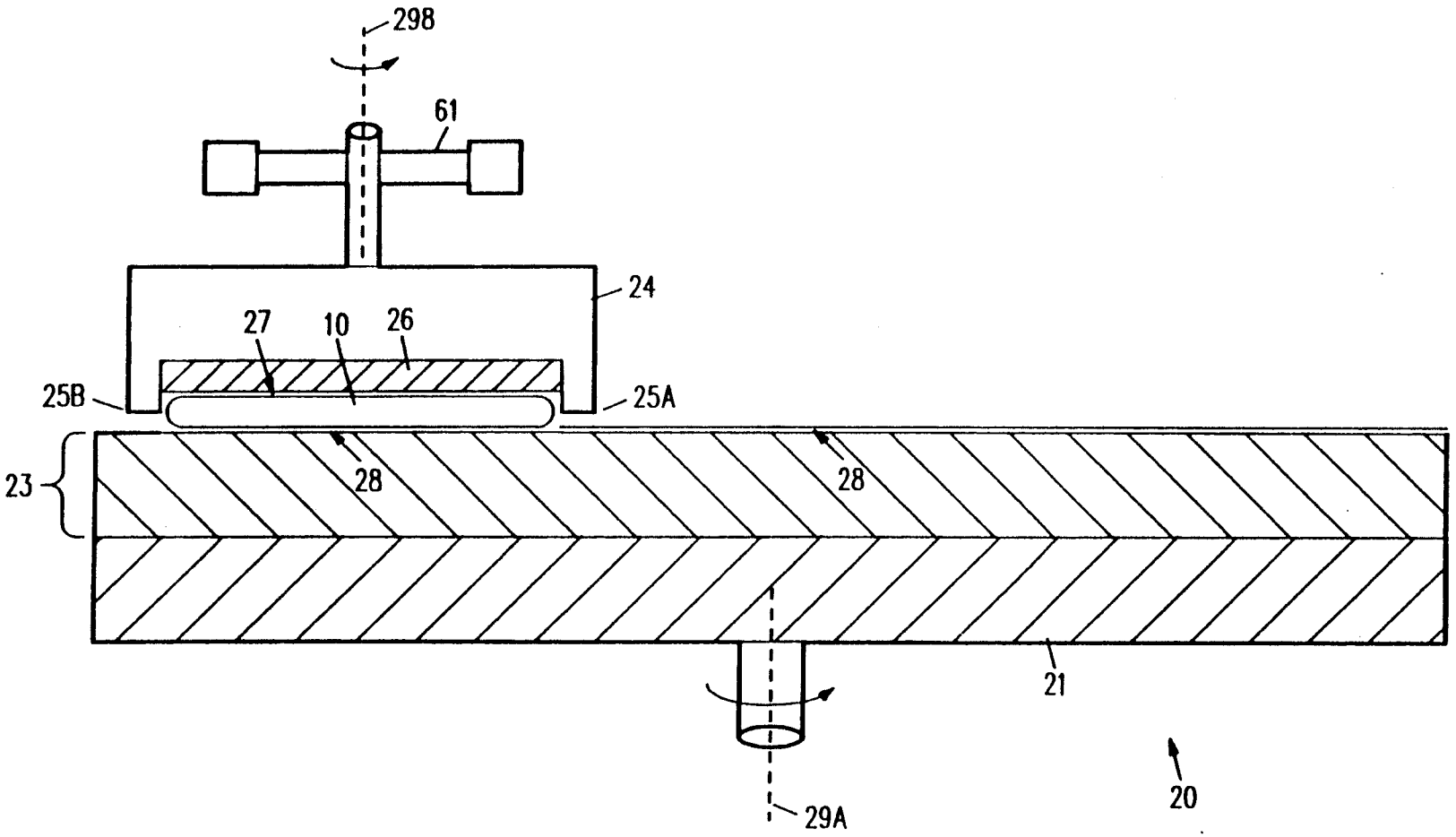
PRIOR ART FIG. 4
FIG. 4 is a cross section of a wafer polishing apparatus including a polishing pad according to the prior art.
Figure 5:
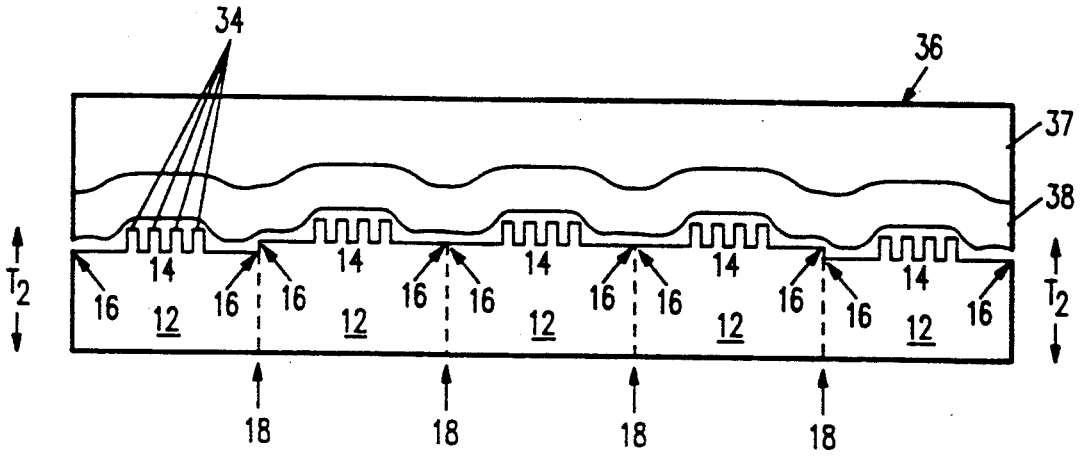
PRIOR ART FIG. 5
FIG. 5 is a cross section of a polishing pad having a polishing layer and a resilient layer according to the prior art.

Referring to FIG. 7, an exploded view of a low density region of the wafer of FIG. 6 taken along lines 6'—6' is shown. The cross section view shows a first high density region 14A, a second high density region 14B, and a low density region 16 having a lateral dimension (L). The steps 34 located at the high density regions 14 are generally spaced in the order of 1 um apart. The steps 34 approximately have an average height of (h=1.0 um). The low density regions 16 between two adjacent high density regions 14 are usually the largest lateral dimension gaps on the wafer surface. The lateral distance L between two high density regions 14 may however range from 0.1 mm to 2.0 cm, depending on the type of ICs fabricated on the wafer.

For a large gap on the wafer surface, the polishing pad 50 gradually flexes downward toward the center of the gap. In the preferred embodiment of the invention, the polishing pad 50 should apply a sufficient polishing pressure so that polishing layer 52 flexes by an amount equal to approximately (½ h) or approximately 50% the average height of the step (½ h) or approximately 0.5 um for the wafer shown in FIG. 7.

In alternative embodiments of the present invention, the amount of pressure applied to the pad 50 should be sufficient so that the pad 50 flexes an amount equal to approximately 5 to 95 percent of the height (h) of the steps on a given wafer. The amount of pressure required to achieve the desired flex in the polishing pad may range from 1 to 15 psi, and the amount of actual pad flex may range from 0.1 to 2.0 microns, depending on the physical attributes of the wafer.

The amount of deflection or flex (F) induced in the polishing layer 52 by the rigid layer 54 may be approximated or modelled by the beam flexure equation:

$$F=CPW^4/Et^3 \quad (1)$$

where W is lateral dimension of a particular feature on the wafer being spanned by the pad, C is a constant, P is a selected polishing pressure, E is the elastic modulus of the rigid layer material, and t is the thickness of the rigid layer. The value of constant C is dependent on the shape or dimensions of the selected low density region 16. If W is the width of a long narrow region, such as a scribe line 18, the value of C is 5/32. However, if a shorter low density region 16 is selected (for example a square low density region having equal width and length), a smaller value of C may be appropriate.

Similarly, the required thickness t for rigid layer 54 may be approximated by re-arranging equation (1) and solving for t:

$$t=[2CPW^4/Eh]^{\frac{1}{3}} \quad (2)$$

In a preferred embodiment, using a stainless steel rigid layer 54 with an elastic modulus (E=25E6 psi), a typical value of polishing pressure P=6 psi; h=1 um; C=5/32, and W=5 mm and a flex (F=h/2=½ micron), the thickness of rigid layer 54 is approximated to equal (t=0.14) inches Other embodiments of the invention will be apparent to those skilled in the art from a consideration of this specification or practice of the invention disclosed herein. For example, any pad operating in the elastic flexure mode and having more than or less than three layers may be used. Different materials, such as gels, various metals, plastics, epoxies, etc. having the same or similar functional characteristics as describe herein could be used in such pads. In addition, polishing pads having individual layers that have varying physical and functional characteristics as described herein may be used (i.e., a resilient layer having one degree of resiliency at the bottom of the layer and a second degree of resiliency at the top of the layer). It is intended that the specification be exemplary only, with the true scope and spirit of the invention being indicated by the following claims.

What is claimed is:

1. A polishing pad for selectively polishing and planarizing a semiconductor wafer having regions of device integration density formed on a surface of the semiconductor wafer, the regions of device integration density being separated from one another by lateral gaps on the surface of the semiconductor wafer, the polishing pad comprising:

(a) a polishing layer having a nonabrasive polishing surface for polishing and planarizing the surface of the wafer;

(b) a substantially nonelastic rigid layer of selected rigidity positioned adjacent to the polishing layer; and (c) a resilient layer positioned adjacent to the rigid layer;

wherein the substantially nonelastic rigidity of the rigid layer is established by selecting a material therefor with a modulus of elasticity and thickness whereby a substantially uniform pressure applied to the resilient layer causes the resilient layer and the rigid layer together to apply an elastic flexure pressure to the polishing layer such that the polishing pad has a leveling length equal to the largest lateral gap on the surface of the wafer.

2. The polishing pad of claim 1 wherein the rigidity of the rigid layer is selected such that the leveling length of the polishing pad is between 0.5 mm–2.0 cm.

3. A polishing pad for selectively polishing and planarizing a semiconductor wafer having a plurality of spaced-apart steps having an average height h formed on a surface of the wafer, the polishing pad comprising:

(a) a polishing layer having a nonabrasive polishing surface for polishing and planarizing the surface of the wafer;

(b) a substantially nonelastic rigid layer of selected rigidity positioned adjacent to the polishing layer; and (c) a resilient layer positioned adjacent to the rigid layer;

wherein the substantially nonelastic rigidity of the rigid layer is established by selecting a material therefor with a modulus of elasticity and thickness whereby a substantially uniform pressure applied to the resilient layer causes the resilient layer and the rigid layer together to apply an elastic flexible pressure to the polishing layer such that, in the spaces between the steps, the polishing surface flexes a controlled amount equal to 5–95% of the average height h of the steps on the surface of the wafer.

4. The polishing pad of claim 3 wherein the polishing surface flexes an amount equal to approximately 50% of the average height h of the steps on the surface of the wafer.

5. The polishing pad of claim 3 wherein the polishing surface is less than 0.003 inches thick.

6. The polishing pad of claim 3 wherein the resilient layer comprises a material having a compression modulus of 300 to 600 pounds per square inch.

7. The polishing pad of claim 6 wherein the resilient layer is 0.030 to 0.060 inches thick.

* * * * *